US005595626A

United States Patent [19]

Yokouchi et al.

[11] Patent Number: 5,595,626

[45] Date of Patent: Jan. 21, 1997

[54] TAPE DISPENSER

[75] Inventors: Nobuo Yokouchi, Soka; Hiroyuki Saito, Ishioka, both of Japan

[73] Assignee: Pentel Kabushiki Kaisha, Japan

[21] Appl. No.: 362,469

[22] PCT Filed: Apr. 11, 1994

[86] PCT No.: PCT/JP94/00605

§ 371 Date: Dec. 21, 1994

§ 102(e) Date: Dec. 21, 1994

[87] PCT Pub. No.: WO94/25385

PCT Pub. Date: Nov. 10, 1994

[30] Foreign Application Priority Data

Apr. 26, 1993 [JP] Japan ..... 5-027173
Jul. 30, 1993 [JP] Japan ..... 5-045869

[51] Int. Cl.[6] ..... B32B 31/00

[52] U.S. Cl. ..... 156/577; 156/523; 156/522; 156/579; 225/56

[58] Field of Search ..... 156/523, 527, 156/530, 574, 577, 579, 522; 225/19, 20, 56, 57, 67

[56] References Cited

U.S. PATENT DOCUMENTS 3,829,346 8/1974 Sullivan ..... 156/527
4,090,914 5/1978 Hauk et al. ..... 156/523
4,486,263 12/1984 Gomez ..... 156/523
4,582,558 4/1986 Antonson ..... 156/523
5,342,466 8/1994 Eidson ..... 156/523

FOREIGN PATENT DOCUMENTS 49-41030 11/1974 Japan .
55-143257 10/1980 Japan .
58-51160 11/1983 Japan .

*Primary Examiner*—James Engel
*Attorney, Agent, or Firm*—Adams & Wilks

[57] ABSTRACT

A tape dispenser comprises a body having a dispensing end for dispensing a tape and a size capable of being gripped by a hand of a user. A holding member is disposed in the main body and supports a roll of the tape to permit the roll of tape to undergo displacement in a first direction. A pressing member having a pressing portion at the dispensing end of the main body receives the tape from the roll of tape and presses the tape against a surface for adhering the tape to the surface. A clamping unit applies a clamping force to the tape to releasably clamp the tape at the dispensing end of the main body. A cutting unit is pivotally connected to the holding member and has a blade portion for cutting the tape at the dispensing end of the main body. The blade portion is displaceable between a first position toward the dispensing end of the main body and a second position away from the dispensing end of the main body. Displacement of the blade portion from the first position toward the second position displaces the roll of tape in the first direction to slacken a portion of the tape between the roll of tape and the dispensing end of the main body.

37 Claims, 12 Drawing Sheets

TAPE DISPENSER

TECHNICAL FIELD OF THE INVENTION

This invention relates to a tape dispenser which has a main body having a tape holding portion capable of holding a wound adhesive tape and a blade portion capable of cutting a tape pulled out, and having a size capable of being gripped by a hand.

BACKGROUND OF THE INVENTION

Tape dispensers of adhesive tapes typified by cellophane (Scotch) tapes are generally of a desk-top type. An example of a desk-top type tape dispenser is shown in FIG. 25. A main body 1 of the tape dispenser D has a narrow portion 5 for extending a tape 4 between a tape holding portion 2 and a blade portion 3, and when fingers are inserted Into the narrow portion 5 to grip and pull the tape, the tape 4 can be pulled out while the tape dispenser D is kept placed on the desk, etc. However, when this desk-top type tape dispenser Is used, finger print-like contamination remains on the adhesive surface of the tape 4 and the bonding power of the tape 4 is likely to decrease due to dirt on the fingers. Further, the cut tape 4 itself Is likely to undergo self-adhesion before it is bonded to paper, a film, or the like, for some reason or other, such as due to twisting of the tape. More often than not, one has experienced an annoying experience where the adhesive surfaces of the cut tape adhere to each other, and cannot be peeled easily with the result that, the tape must be discarded. Further, when the tape 4 or paper is twisted after the tape 4 is bonded to paper, etc, creases are developed in many cases.

In contrast, a tape dispenser which is small in size and light in weight as a whole and can be used while being gripped by a hand is known. An example is shown in FIG. 26. This type is referred to as the "portable type" in comparison with the desk-top type of tape dispenser described above. While the tape dispenser D (fundamentally, like reference numerals and characters will be used to identify like portions) is gripped by one hand, the tape 4 is pulled out by the other hand, the distal end portion of the tape 4 so pulled out is bonded to paper, etc, the bonding region is gradually elongated, the tape dispenser D gripped by the hand is moved while caution is paid so as not to peel the tape, whenever necessary, and after the tape 4 is further pulled out in this way, the major proportion of the tape 4 is bonded and then the tape 4 is cut. In comparison with the desk-top type tape dispenser described above, this portable type tape dispenser has higher continuity of the tape pull-out operation and the tape bonding operation and can particularly suppress sufficiently the problem of self-adhesion of the tape 4 itself. However, the necessity for pinching the tape 4 between the fingers remains, though the level of the necessity can be certainly reduced. Accordingly, contamination of the adhesive surface of the tape 4 and the drop of bonding power cannot be sufficiently suppressed. Further more, creases often occur after the tape is bonded to paper, etc.

SUMMARY OF THE INVENTION

It is an object of the present invention to provide a tape dispenser which can solve the problems of the prior art technology described above, can sufficiently eliminate self-adhesion of the cut tape before the tape is bonded to paper, etc, can eliminate the necessity for a user to pinch the tape with fingers to pull out the tape so as to sufficiently suppress contamination of the tape adhesive surface resulting in a decrease in bonding power of the tape due to dirt in the hand of the user, can pull out the tape while sufficiently eliminating the possibility of erroneous cut and damage to the tape, can bond the tape in a desired length and can moreover cut the tape without greatly changing the grip angle of the main body.

These and other objects of the present invention will become more apparent from the following description.

First, the technical concept we have examined during the process for completing the present invention will be described with reference to FIGS. 27 to 30. As shown in FIGS. 27 and 28, a tape press portion 6 is disposed on the tape pull-out side of the main body 1 of the tape dispenser D, and the tape 4 is pressed by the tape press portion 6 from the back side opposite to the adhesive surface (the lower part of the tape In the drawings) so that the distal end portion of the tape 4 pulled out can be bonded to paper, etc. According to this arrangement, the tape 4 need not be pinched by fingers, so that contamination of the adhesive surface of the tape 4 and the drop of its bonding power can be sufficiently suppressed. Moreover, because the tape pull-out operation directly leads to the tape bonding operation, the occurrence of the creases after bonding can also be suppressed sufficiently. When a blade portion 3 is disposed further at the distal end of the tape press portion 6 as shown in FIGS. 29 and 30, the tape 4 can be cut by changing the grip angle of the main body 1.

However, the inventors of the present invention have confirmed that there are yet left some points to be improved In the tape dispenser described above. In other words, there remain the possibility that the tape 4 is erroneously cut during the tape pressing and bonding operation when the grip angle of the main body 1 changes, and even when the tape 4 is not cut, it might be damaged. Needless to say, it is possible to employ the construction wherein the fitting position of the blade portion 3 is set so that the tape 4 cannot be cut unless the grip angle of the main body 1 is greatly changed. However, this means that unless the grip angle of the main body 1 is greatly changed, the tape 4 cannot be cut, or the cutting operation becomes inconvenient.

In view of the above, the present invention provides a tape dispenser comprising a main body having a tape holding portion capable of holding a wound adhesive tape and a blade portion capable of cutting the pulled out tape, and having a size capable of being gripped by a hand, wherein a tape press portion capable of pressing the tape to a surface from the back or non-adhesive side of the tape is disposed at a tape pull-out distal end portion of the dispenser, the blade portion is positioned in front of the tape press portion under a free state, and at least one of the tape portion and the blade portion has a displacement property such that the blade portion and the tape press portion are allowed to relatively escape and undergo displacement when a force is applied thereto. The expressions "displacement property" which allows "the blade portion and the tape press portion to relatively escape and undergo displacement" means that the blade portion and the tape press portion can undergo relative displacement so that an angle defined between the gripping direction of the main body and a direction connecting the tape press point by the tape press portion to the blade becomes smaller at the time of the operation of the tape press portion. This arrangement will be explained on the basis of the drawings as follows.

In FIGS. 31 to 33, the dotted line represents the gripping direction of the main body of the tape dispenser. For the sake of convenience of explanation, this direction may be only equal throughout in FIGS. 31 to 33 and for this reason, the dotted line is shown drawn perpendicularly to the sheet of the drawings. One-dot-chain line represents the direction connecting the tape press point by the tape press portion 6 to the blade of the blade portion 3. The angle defined by the dotted line and the one-dot-chain line, that is, the angle defined between the gripping direction of the main body of the tape dispenser and the direction connecting the tape press point by the tape press portion 6 to the blade of the blade portion 3 is expressed by "$\alpha$" in FIG. 31, by "$\beta$" in FIG. 32 and by "$\gamma$" in FIG. 33. The angle $\alpha$ in FIG. 31 is the reference. Unless the blade portion and the tape press portion do not undergo relative displacement, the angle $\alpha$ remains at a set constant value in any of pullout, bonding and cutting of the tape 4 (provided that the change of the tape press point due to the thickness of the tape press portion is neglected). In contrast, the angle $\beta$ in FIG. 32 is shown as a smaller angle than $\alpha$ ($\beta<\alpha$). It can be understood that when the tape 4 is pulled out and bonded, the angle $\beta$ shown in FIG. 32 is much more preferred to the angle $\alpha$ in FIG. 31 because erroneous cutting and damage of the tape can be suppressed. Naturally, when the angle remains at $\beta$ at the time of cutting of the tape 4, the grip angle of the main body must be changed greatly as already described. Therefore, when the tape 4 is cut, the angle is made greater than $\beta$. In other words, FIG. 33 shows the state where the tape 4 is cut, and the angle $\gamma$ at point time is greater than $\beta$ ($\beta<\gamma$).

The explanation given above means that the condition "$\beta<\alpha$, $\beta<\gamma$" must be satisfied. Incidentally, the angle $\delta$ in FIG. 33 corresponds to the change in grip angle of the main body when the tape 4 is cut (with the proviso that the tape thickness, etc, is neglected). This angle $\delta$ can be set to 0°, for example, depending on how angles $\alpha$, $\beta$ and $\gamma$ are set.

BRIEF DESCRIPTION OF PREFERRED EMBODIMENTS

Figure 1:
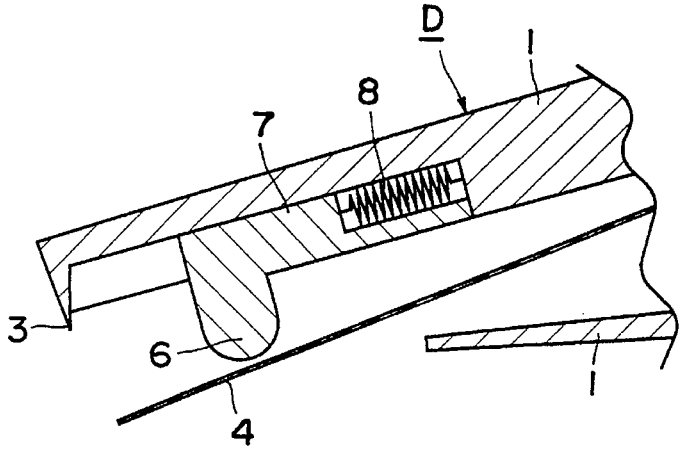
FIG. 1 is a sectional view of principal portions of a tape dispenser according to an embodiment of the present invention.
Figure 2:
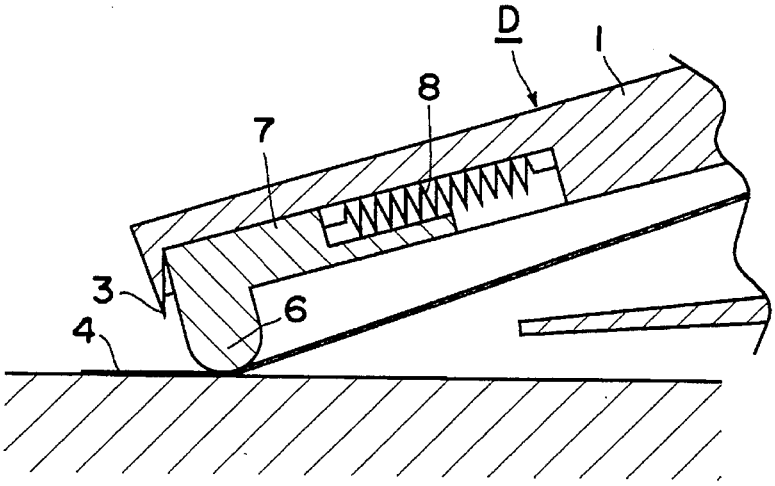
FIG. 2 is a diagram for explaining an operational mode of the device shown in FIG. 1.
Figure 29:
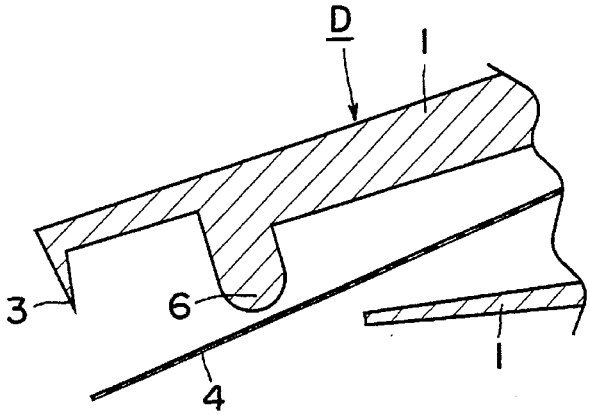
FIG. 29 is a sectional view of principal portions of a tape dispenser for explaining the problems to be solved in the present invention.
Figure 30:
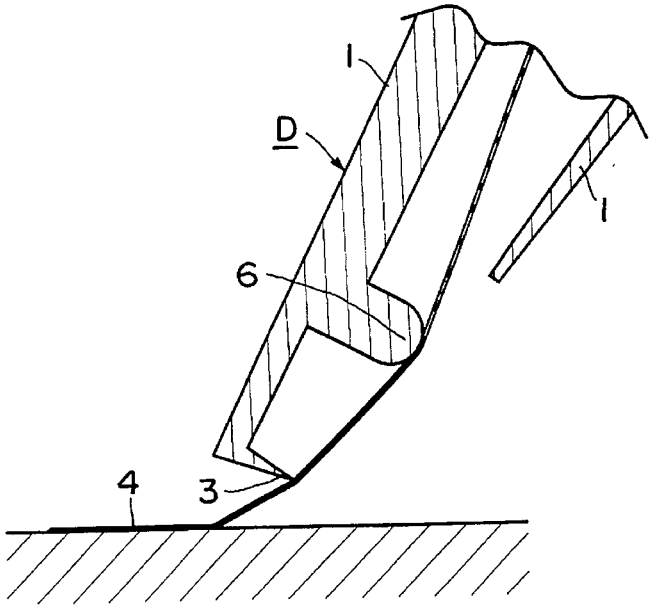
FIG. 30 is an explanatory view for explaining the operational mode of the device shown in FIG. 29.
Figure 31:
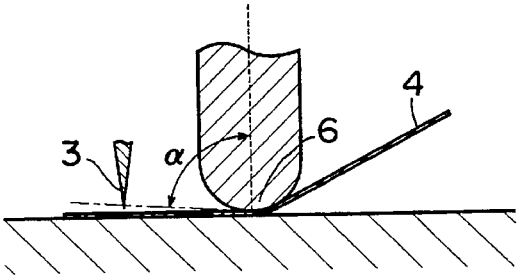
FIG. 31 to 33 are diagrams for explaining relative escape displacement between the tape pressure portion and the blade portion in the present invention.
Figure 32:
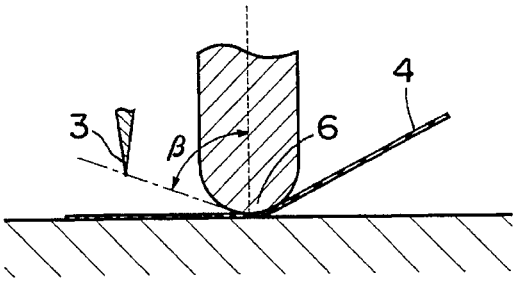
Figure 33:
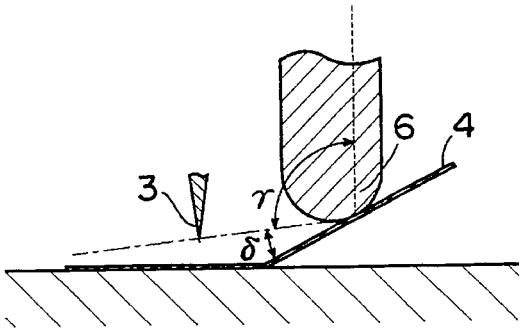

An embodiment of the invention will be explained with reference to FIGS. 1 and 2. Unlike the device shown in FIGS. 29 and 30, the tape press portion 6 in this embodiment is disposed on a tape press member 7 which is separate from the main body 1 and is slidably fitted to the main body 1. The tape press member 7 receives a tensile force by a tension spring 8. When a tape 4 is pressed and bonded, the tape press member 7 approaches the blade portion 3 against the force of the tension spring 8 by utilizing the frictional resistance occurring between the tape pressure portion 6 and the tape 4. When the tape 4 is cut, the frictional force becomes smaller. Accordingly, the tape press member 7 moves away from the blade portion 3 by the tensile force of the tension spring 8. In other words, the device of this embodiment is constructed so as to bond the tape 4 under the state shown in FIG. 2 and to cut the tape 4 under the state shown in FIG. 1, and the embodiment of FIGS. 1 and 2 represents an example where the tape press portion 6 is caused to escape and to undergo displacement with respect to the blade portion 3. Although the entire portion of the device is not shown in the drawing, the main body 1 has a size Which can be gripped by a hand. (The same is true of the description hereinafter.)

Figure 3:
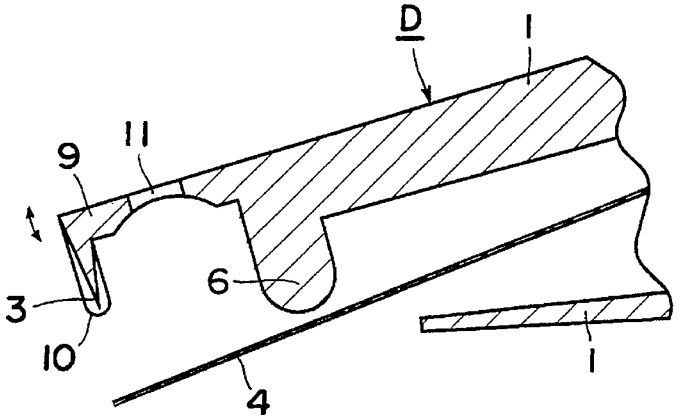
FIG. 3 is a sectional view of principal portions of a tape dispenser according to another embodiment of the present invention.
Figure 4:
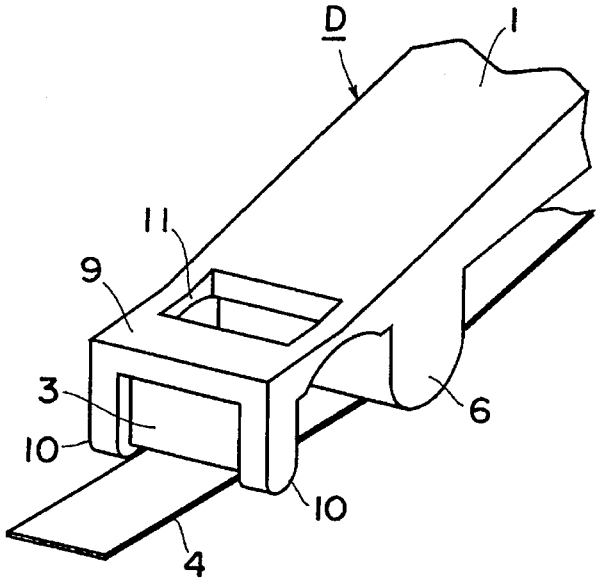
FIG. 4 is a diagram for explaining an operational mode of the device shown in FIG. 3.
Figure 5:
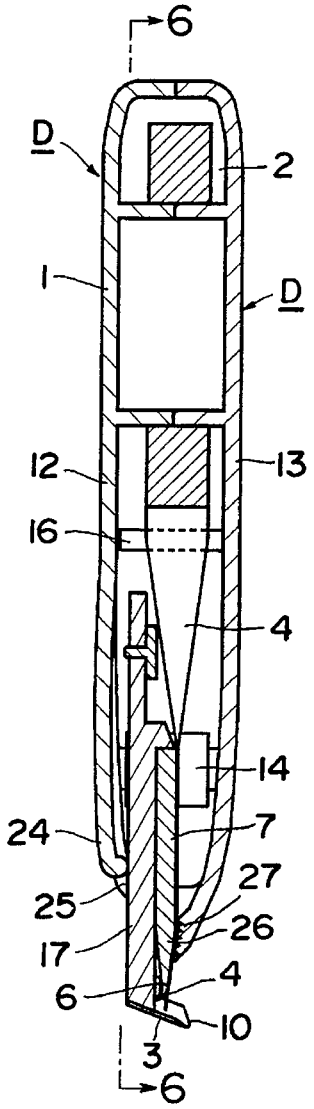
FIG. 5 is a sectional view of a tape dispenser according to still another embodiment of the present invention.

Next, another embodiment will be explained with reference to FIGS. 3 and 4. In this embodiment, the blade portion 3 is disposed as a swingable portion 9 of the main body 1.

Tape protective portions 10 which protrude slightly beyond the blade are disposed on both sides of the blade of the blade portion 3. Each tape protective portion 10 not only contributes to some extents to the prevention of injury but also comes into contact with the article, such as taper when the tape 4 is bonded and positions the blade of the blade portion 3 to a position slightly spaced apart from the tape 4. Accordingly, the protrusion distance defines a recess having a height capable of forming a gap between the tape 4 pulled out and bonded to the surface of the article and the blade 3.

When the tape protective portion 10 is brought into contact with the article, such as taper, the blade portion 3 swings flexibly due to the reaction of the contacting force. In other words, this embodiment represents an example where the blade portion 3 is allowed to escape and to undergo displacement with respect to the tape press portion 6. Because the device of this embodiment does not utilize a frictional force, the escape and displacement performance of the blade portion 3 is more reliable than that of the foregoing embodiment. A through-hole 11 formed between the blade portion 3 and the tape press portion 6 assists with the partly setting of the flexible deformation force of the swingable portion 9 and makes the distal end portion of the tape 4 easily visible when bonding of the tape is started. However, the through-hole 11 may be omitted when a material having suitable flexibility and transparency is selected.

When the blade portion 3 and the tape press portion 6 are relatively escaped and displaced in the foregoing two embodiments, the former undergoes sliding and the latter swinging. However, the directions of displacement may be set to various directions. An embodiment for the displacement in various directions will be explained with reference to FIGS. 5 to 11. This embodiment represents an example which satisfies displacement having both freedoms of sliding and swinging.

The main body 1 of the tape dispenser D is a flat container-like structure as a whole. The main body consists of an upper cover body 12 and a lower cover body 13 and stores therein the tape 4. However, a tape holding portion 2 may have a structure such that the wound portion of the tape 4 is exposed. The tape press portion 6 is disposed on the tape press member 7 which is separate from the main body 1. The tape press member 7 has portions 14, 15 fixing 14 to the main body 1 on both sides thereof (see FIG. 7). Though the tape press member 7 is not slidable, it has a swinging property to a certain extent due to the flexible material from which it is fabricated. In order to particularly restrict variance of the press force at the time of bonding of the tape 4, the tape press portion 6 has a small thickness so as to exhibit suitable flexibility in addition to the press force.

The tape press member 7 defines a vertical wall surface between it and a pin 16 protrusively formed on the lower cover body 1S. The pin 18 and the tape press member 7 guide the tape 4, twist the tape 4 by 90° inside the main body 1, and pull it out. Since flatness of the main body 1 is aligned with that of the tape 4, the operation factor can be improved in comparison with the case where the tape 4 is pulled out without twisting, when the main body 1 is gripped by hand and is operated.

Figure 10:
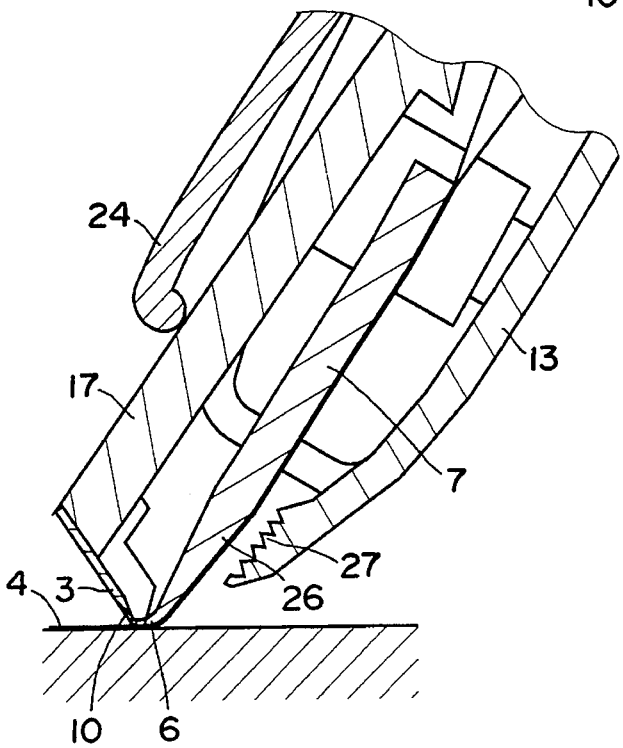
FIGS. 10 and 11 are explanatory sectional views for explaining an operational mode of the device shown in FIG. 5.
Figure 11:
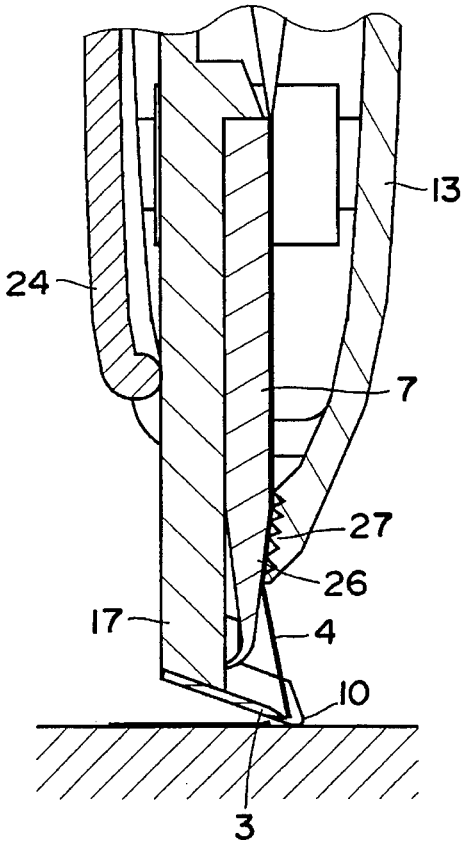

The blade portion 3 is disposed on a blade member 17 which is separate from the main body 1. The blade member 17 can swing with a shaft support portion 20 of an arm 19 urged by a tension spring 18 (see FIG. 6) being the center, and is so biased as to protrude from the main body 1 by the crank mechanism due to connection with the arm by a connecting pin 21. It also has slidability with respect to the tape press member 7. The blade member 17 is further biased flexibly towards the tape press member 7 side from the back portion 25 by a flexible press portion 24 constituted by two notches 22, 23 (see FIG. 9) formed on the upper cover body 12, and has the swinging property with respect to the tape press member 7. This swinging property is greater than the swinging property of the tape press member 7 described above. The blade of the blade member 17 is slanted (see FIG. 8), and this serves as a device for reducing the tape cut force. The flexible biasing force by the flexible press portion 24 acts further on the tape press member 7 through the blade member 17. Due to this biasing force, the tape press member 7 and the lower cover body 13 of the main body 1 apply a contact force to each other at a part of the wall surface. The tape press member 7 also has a clamp plate portion 26 disposed rearwardly of the tape press portion 6. The lower cover body 13 has a clamp plate reception portion 27 disposed at a position opposite to and facing clamp plate portion 26. The clamp plate portion 26 and clamp plate reception portion 27 together constitute a chuck member for clamping the tape 4 from both of its surfaces. Due to this clamping, the distal end position of the tape 4 can be kept stable until bonding of the tape 4 is started. It is also understood, however, the tape dispenser according to the present invention can be also used as a dispenser for non-adhesive tape. Accordingly, the clamp plate reception portion 27 positioned on the adhesive surface of the tape 4 is disposed as a plurality of protuberances in the drawing so that the tape 4 can easily move when the tape 4 is applied for adhesion. This is based on the concept that the reception portion 27 can be brought into contact with the tape 4 broadly region-wise but narrowly area-wise, but another concept relying on the surface treatment for easy peeling can also be employed by providing, for example, a satin-like finish. When a tape having double adhesive surfaces is used, such a concept as described above may naturally be applied to the clamp plate portion 26. Namely, the clamp plate portion 26 may have projections at a predetermined portion for contacting the tape surface. The tape 4 can be bonded by using the tape dispenser of this embodiment in the following way. As shown in FIG. 10, the blade member 17 swings against the flexible biasing force of the flexible press portion 24 and slides towards and inside the main body 1 against the tensile force of the tensile spring 18. The tape press member 7 also swings a little and releases clamping of the tape 4 by the clamp plate reception portion 27 at the clamp plate portion 26, and the tape press portion 6 presses the distal end of the tape 4 to an article, such as taper. The blade 3 is kept spaced apart from the tape 4 by the tape protective portion 10. In this way, the tape 4 can be bonded without being damaged or cut even when the grip angle of the main body or the pressure applied to the tape press portion 6 changes to some extent. When the tape 4 is cut as shown in FIG. 11, the grip angle of the main body 1 is changed while the tape press portion 6 is slightly floated or lifted upwardly. Then, while clamping of the tape 4 by the clamp plate portion 26 and the clamp plate reception portion 27 is recovered, the tape 4 can be cut by the blade portion 3 protruding from the main body 1. The tape protective portion 10 may be kept in contact with the article, or may be kept under the "floating" state. Finger force may also be applied to the flexible press portion 24, whenever necessary.

Figure 6:
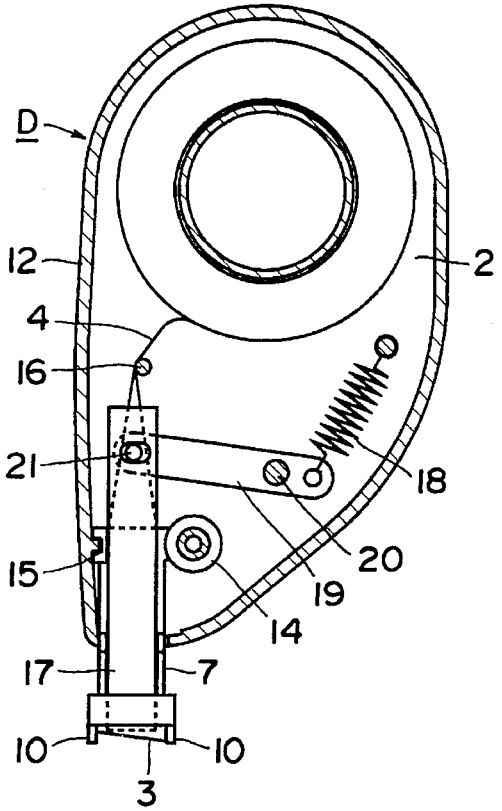
FIG. 6 is a sectional view taken along a line 6—6 in FIG. 5.
Figure 7:
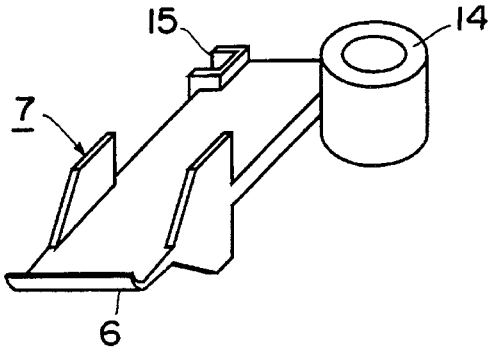
FIG. 7 is a perspective view of a tape press member in FIG. 5.
Figure 8:
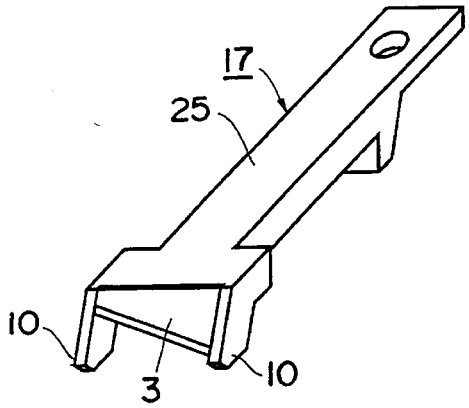
FIG. 8 is a perspective view of a blade member in FIG. 5.
Figure 9:
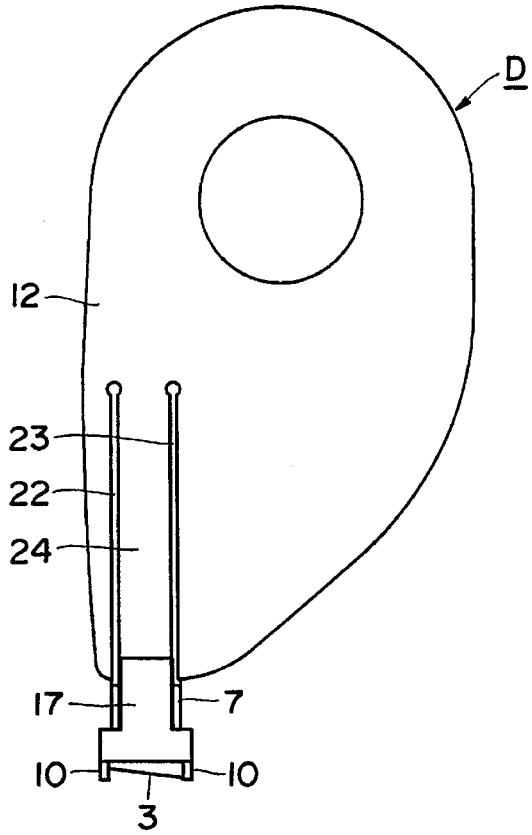
FIG. 9 is a left-hand side view of the device shown in FIG. 5.
Figure 12:
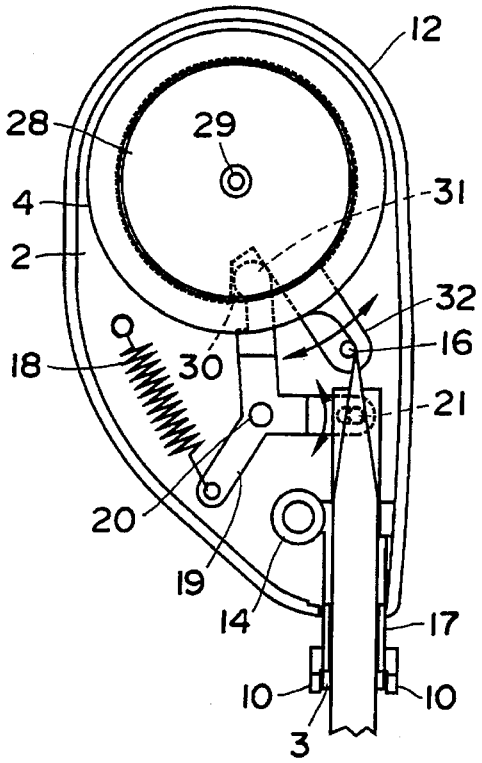
FIG. 12 is an internal structural view of a tape dispenser in still another embodiment of the present invention.

Next, another embodiment of the present invention will be explained with reference to FIG. 12. In order to prevent as much as possible the disassembly of the internal structure in the foregoing embodiments when the upper cover body 12 and the lower cover body 13 of the main body 1 are separated from each other to change the tape 4, etc, it be preferred that the internal structure is kept retained as a whole by either the upper cover body 12 or the lower cover body 13. This embodiment is directed to keep the internal structure attached to the upper cover body 12 as much as possible. This is the reason why FIGS. 12 and 6 are shown symmetrically to the right and left. FIG. 12 shows the state where the lower cover body 13 is removed and the inside of the upper cover body 12 is exposed. Moreover, when the upper cover body 12 is placed on the table such that its upper surface confronts the table surface as shown in the drawing and the tape is changed on the desk, for example, the tape 4 is kept up toward the upper cover body 12 as much as possible. Suitable components can be integrated or separated, and the upper cover body 12 and the lower cover body 13, for example, can be constituted by a synthetic resin injection molded article in which they are integrally connected by a hinge portion.

In comparison with the foregoing embodiment, this embodiment includes an interlocking structure which is represented by symbol with double arrows and is additionally disposed. In other words, the wound portion of the tape 4 is fitted to the a shaft member 28 and the shaft member 28 is rotatably supported by a shaft support 29 disposed on the upper cover body 12 and has a recess 30 around its peripheral portion. The arm 19 has a rod portion 31 engaging with the recess 80. Accordingly, the swing motion of the arm 19, which moves in cooperation with the slide motion of the blade member 17, is driven in cooperation with the rotation of the shaft member 28. In addition, though the pin 16 is disposed on the lower cover body 13 in the foregoing embodiment, the pin 16 in this embodiment is disposed at a bell crank portion 32 disposed on the shaft member 28 so that the pin 16 regulates the tension to the tape 4 in accordance with the rotation of the shaft member 28. When the blade member 17 moves up on the drawing, the shaft member 28 rotates clockwise by a predetermined angle and slackens the tape 4. When the blade member 17 moves down on the drawing after completion of pull-out of the tape 4, the Shaft member 28 rotates counter-clockwise without moving back the distal end of the tape 4 because the clamp plate portion 26 and the clamp plate reception portion 27 again clamp the tape 4. An actual attempt will reveal that the tape 4 must be pulled out by a stronger force at the initial stage of pullout of the tape 4 than in the subsequent pull-out process. Moreover, the region of the tape 4 that can be bonded at first to the surface of the article is not very wide. Therefore, a force applied to pull out further the tape 4 is sometimes useful only for peeling off, by pulling, the portion of the tape 4 first bonded. According to the tape dispenser of this embodiment, however, the tape 4 can be slackened at the initial stake of pull-out of the tape and such a possibility as pulling off the initially bonded portion of the tape 4 can be sufficiently reduced.

Figure 13:
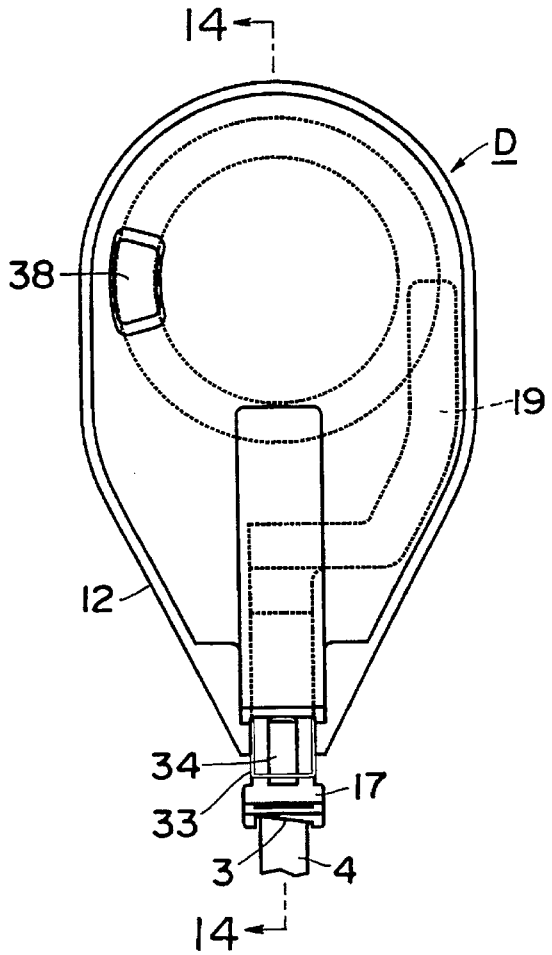
FIG. 13 is a side view of a tape dispenser according to still another embodiment of the present invention.
Figure 14:
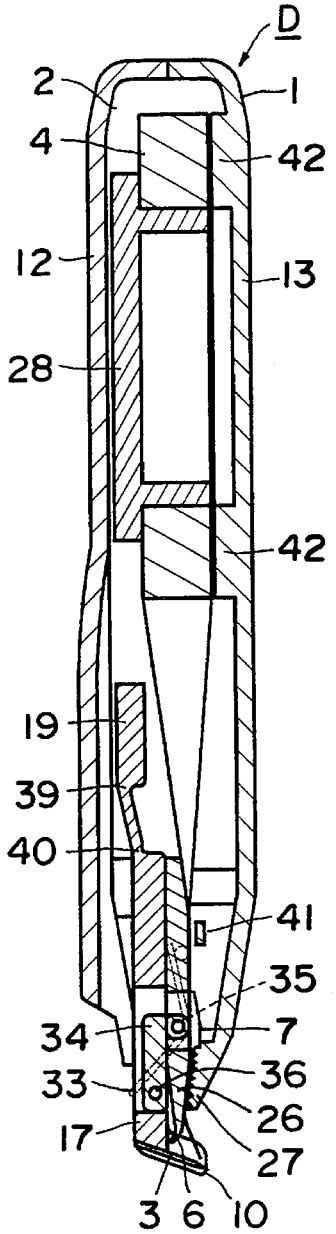
FIG. 14 is a sectional view of the tape dispenser taken along a line 14—14 in FIG.
Figure 15:
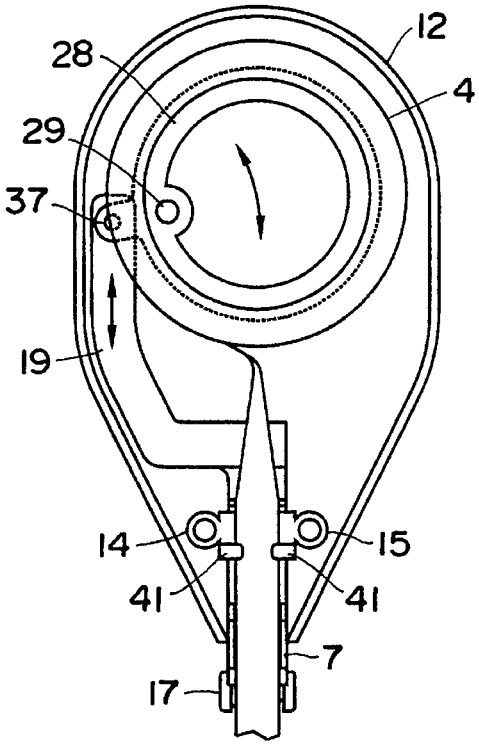
FIG. 15 is a diagram showing an internal structure of the device shown in FIG.
Figure 16:
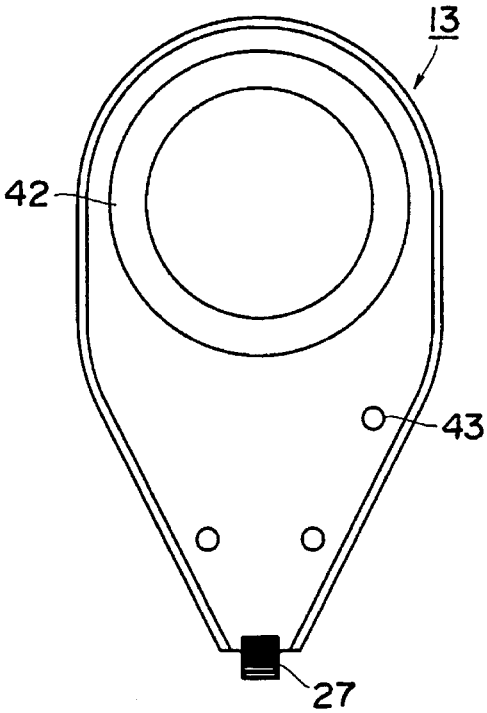
FIG. 16 is a diagram showing an internal surface of a lower cover member in FIG. 13.
Figure 17:
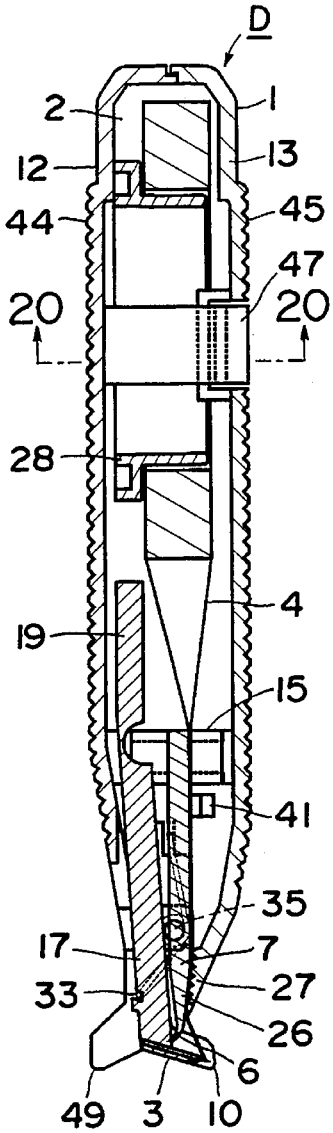
FIG. 17 is a sectional view of a tape dispenser showing still another embodiment of the present invention.
Figure 18:
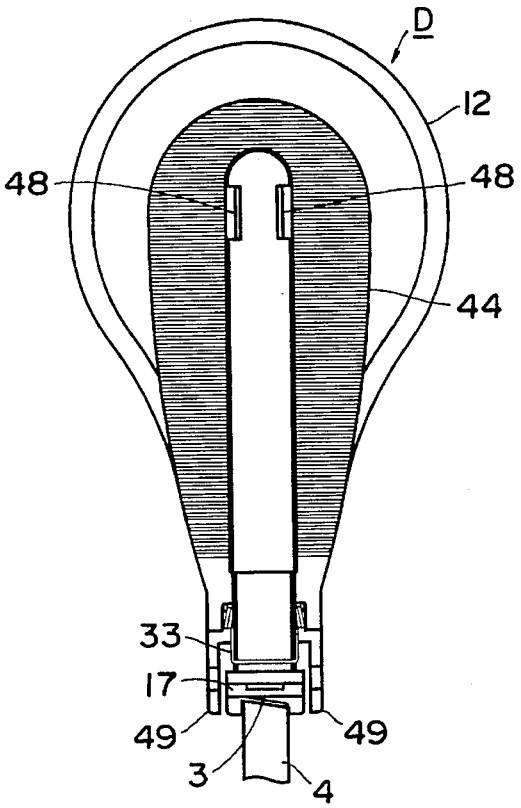
FIG. 18 is a left-hand side view of the device shown in FIG. 17.
Figure 19:
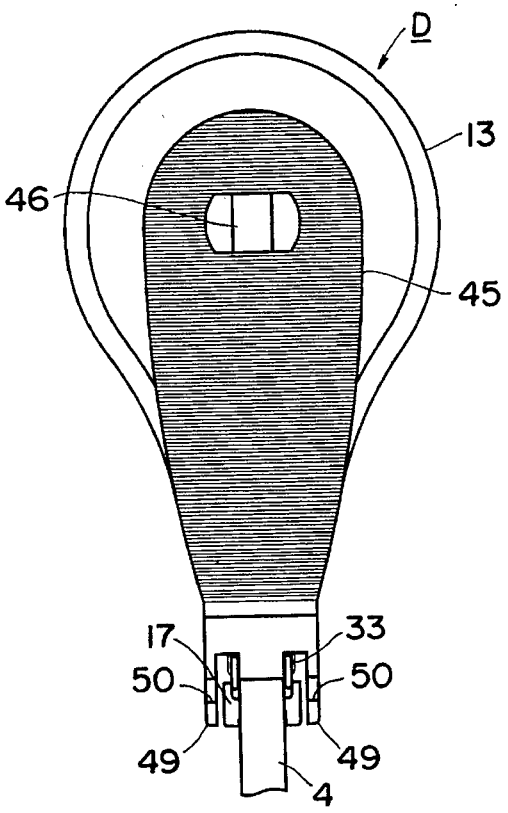
FIG. 19 is a right-hand side view of the device shown in FIG. 17.

FIGS. 13 to 16 show still another embodiment of the present invention. In this embodiment, the upper cover body 12 is not provided with a flexible press portion as the flexible press portion 24 (for example, FIGS. 10 and 11) and does not use a tension spring as the tension spring 18, either. Instead, a flexible displacement property is applied to the tape press member 7 and to the blade member 17 by a torsion coil spring 33 and a lever member 34. The lever member 34 is connected to the tape press member 7 and to the blade member 17 at the positions of the shaft supports 36, respectively. The shaft support 35 serves also as a securing portion for securing the torsion coil spring (FIG. 14). The tape press member 7 is fixed to the main body 1 at the positions of the fixing portions 14, 15 in the same way as in the foregoing embodiments. Accordingly, when the tape protective portion 10 is brought into contact with the article, such as taper, the blade member 17 can flexibly swing and slide due to the reaction of the force, and the tape press portion 6 swings, as well.

In the embodiment of FIGS. 13–16, the afore-mentioned arm 19 is formed integrally with the blade member 17 and is directly connected to the shaft member 28 at the position of the connecting pin 37. The shaft member 28 is fitted to the main body 1 at a portion different from the center portion. The slide motion of the blade member 17 directly produces a slide motion of the arm 19, and the slide motion of the arm 19 is then transmitted to produce a swing motion of the shaft member 28. In other words, this embodiment can slacken the tape 4 at the initial stage of tape pull-out in the same way as in the foregoing embodiments. Moreover, the tape slackening quantity in this embodiment is greater than in the foregoing embodiments. In FIG. 13, reference numeral 38 denotes a window hole disposed in the upper cover body 12 so as to confirm the residual quantity of the tape 4. Reference numerals 39 and 40 in FIG. 14 denote portions of the arm 19 having portions of varying thickness which are disposed so that the swing motion of the blade member 17 is not transmitted to the portion of the arm 19. Reference numeral 41 in FIGS. 14 and 15 denotes a tape support portion disposed on the tape press member 7. It represents an example where the movement and guide member for the tape 4 can be suitably disposed on the tape press member 7. Reference numeral 42 in FIGS. 14 and 16 and reference numeral 43 in FIG. 16 denote protuberances so disposed as to prevent shaking of the shaft member 28 and the arm 19. The protuberances may have a suitable shape. FIGS. 17 to 24 show still another embodiment. The tape dispenser of this embodiment is not provided with the window hole 38. Instead, the main body 1 is made of a material having suitable transparency. As described above, the residual quantity of the tape 4 can be confirmed by this arrangement. The degree of internal transparency may be adjusted by conducting satin crape finish for the surface or coloring it a little. The device of this embodiment is provided with a small rib formation region for preventing slip when the device is gripped (see FIGS. 18 and 19), and this contributes to the adjustment of transparency, too.

Figure 20:
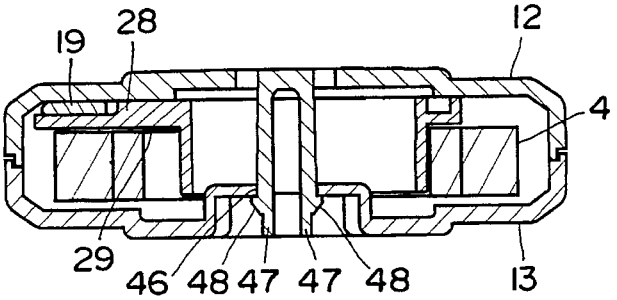
FIG. 20 Is a sectional view of the tape dispenser taken along a line 20—20 in FIG. 17.
Figure 21:
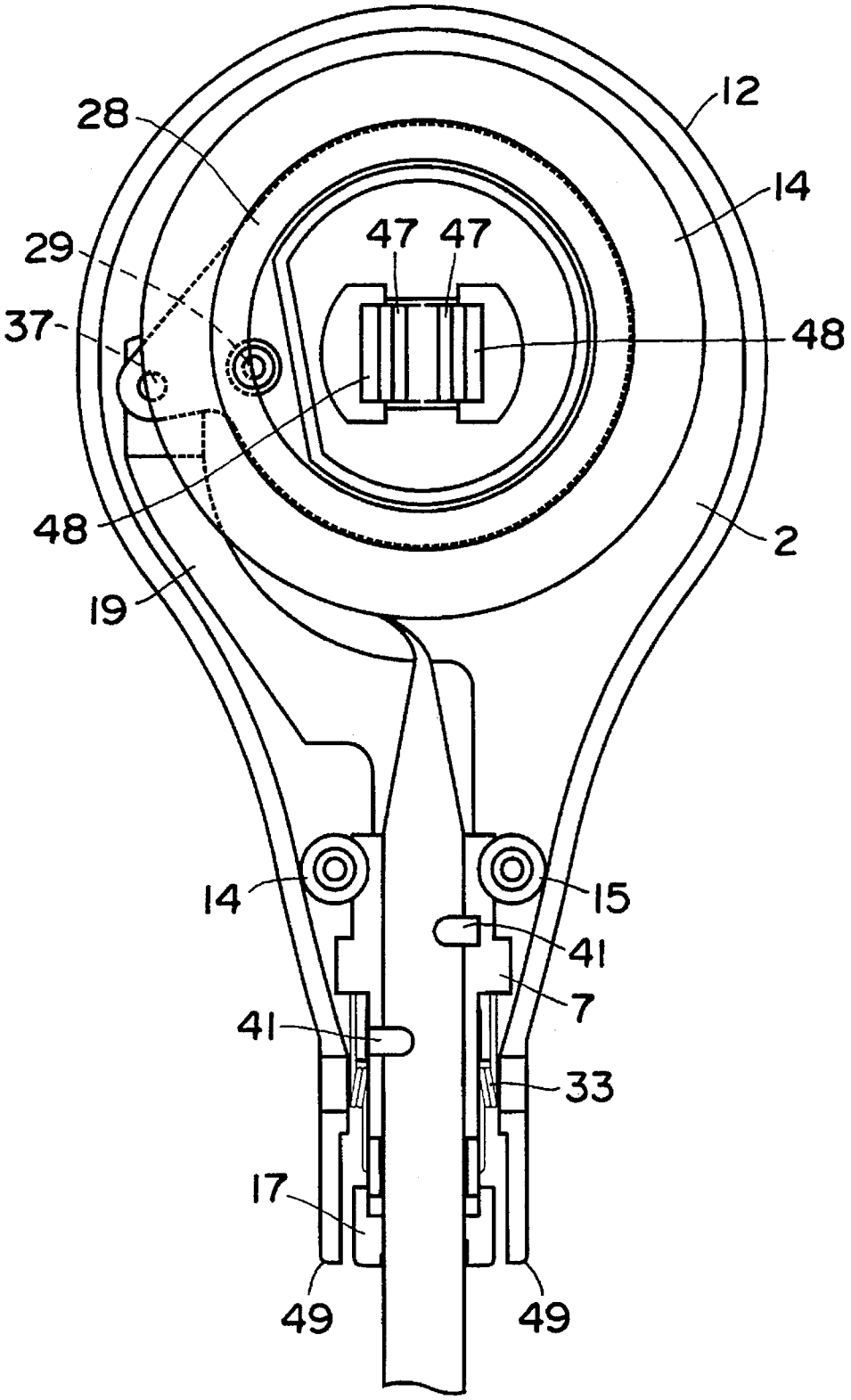
FIG. 21 is a diagram showing an internal structure view of the device shown in FIG. 17.

In this embodiment, the upper cover body 12 and the lower cover body 13 are fixed together when engagement protuberances 48 of a pair of flexible protuberances 47 disposed on the upper cover body 12 engage with through-holes 46 of the lower cover body 13 (see FIG. 20). When both flexible protuberances 47 are deformed by finger tips in such a manner as to bring them close to each other, the upper cover body 12 and the lower cover body 13 can be separated. The width of the projecting end portion of each flexible protuberance 47 is small. Therefore, the upper and lower cover bodies 12, 13 can be fixed by merely aligning the flexible protuberances 47 with the through-holes 46 and pushing the former into the latter.

Further, this embodiment is different from the foregoing embodiments in some details such as in the omission of the lever member 34. However, the greatest difference of this embodiment from the foregoing embodiments lies in the shape of the distal end portion of the upper cover body 12. In other words, a rotation support portion 49 and a contact support portion 50 are disposed at the distal end portion of the upper cover body 12. Due to the existence of the ration support portion 49 and the contact support portion 50, the tape dispenser of this embodiment has a higher operational factor than that of the foregoing embodiments.

Figure 22:
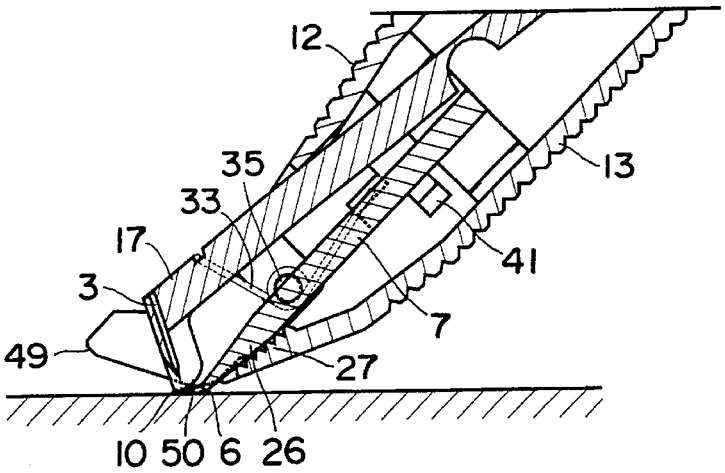
FIGS. 22 to 24 are explanatory sectional views for explaining an operational mode of the device shown in FIG. 17.
Figure 23:
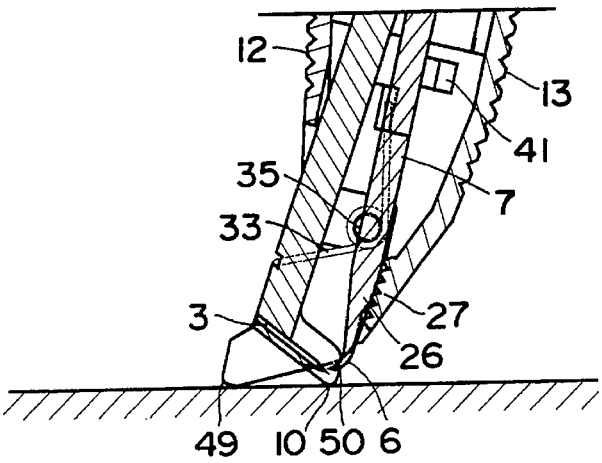

FIG. 22 shows the state where the tape protective portion 10 starts touching the surface of the article on which the tape is to be bonded. The tape press portion 6 has already pressed the tape 4, which is omitted from the drawing, to the article. When the press force is further applied from this state, the contact support portion 50 is also brought into contact with the article. Thereafter, even when the press force changes during the bonding operation of the tape 4, this contact support portion 50 absorbs the change of the force acting on the tape protective portion 10 and the tape press portion 6. This is the reason why the tape 4 can be bonded by a sufficiently stable bonding power. Moreover, the bonding operation of the tape 4 may be carried out under the state where the rotation support portion 49 floats from or is not in contact with the article, and can also be carried out under the state where the rotation support portion 49 is also in contact with the article. This means that the user can freely select, during the bonding operation of the tape 4, the grip angle of the main body 1.

Figure 24:
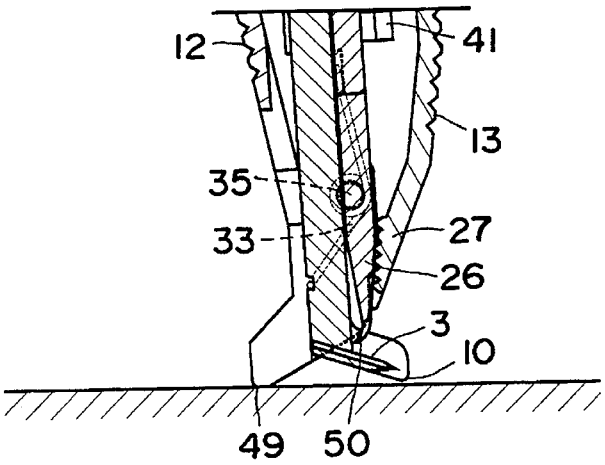
Figure 25:
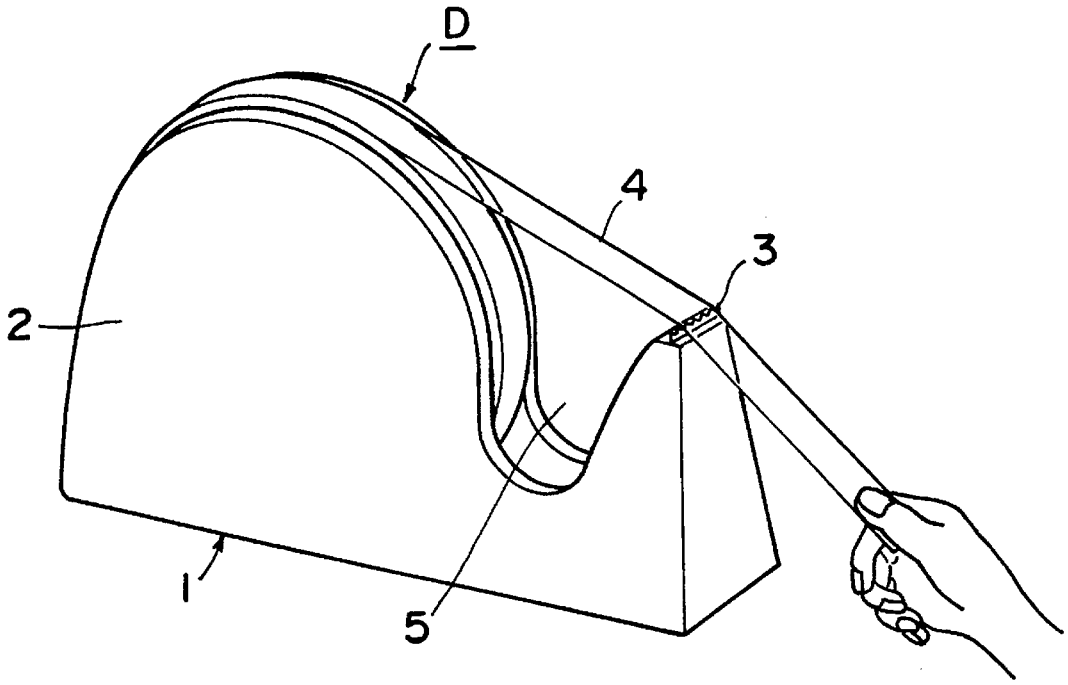
FIG. 25 is a perspective view of a prior art tape dispenser.
Figure 26:
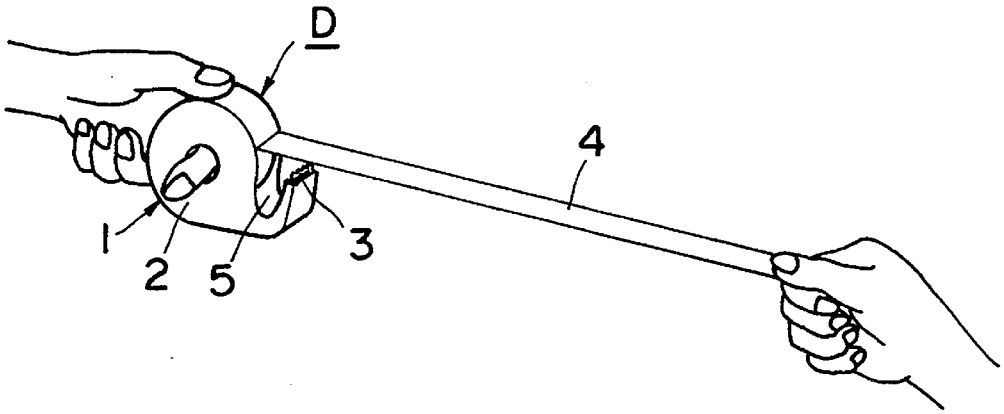
FIG. 26 is a perspective view of another prior art tape dispenser.
Figure 27:
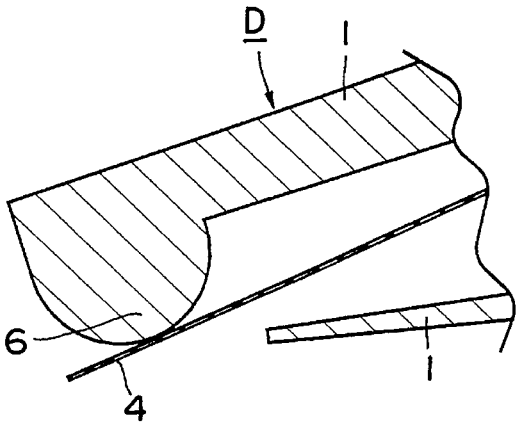
FIG. 27 is a sectional view of principal portions of a tape dispenser for explaining the problems to be solved in the present invention.
Figure 28:
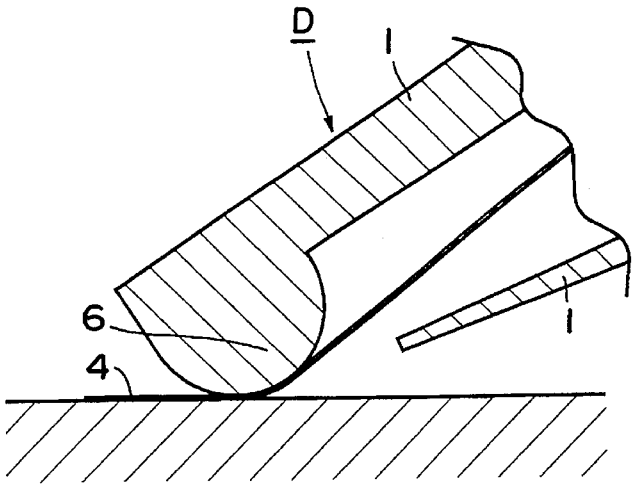
FIG. 28 is an explanatory view of the tape dispenser of FIG. 28 explaining the operational mode of the device shown in FIG. 27.

After bonding of the tape 4 is thus carried out over a desired length, the operation then shifts to the cutting operation of the tape 4. This is the state shown in FIG. 23. The main body 1 need not be intentionally floated up. While the rotation support portion 49 is kept in touch with the article, the main body 1 needs only to be rotated. First, the tape press portion 6 floats and releases the force which presses the tape 4 to the article. Then, the tape protective portion 10 also floats and leaves the article. When the tape protective portion 10 leaves the article, the movement has a certain degree of speed with the exception that the rotation of the main body 1 is deliberately retarded. Therefore, cutting of the tape can be made quickly, and the state shown in FIG. 24 is attained. Accordingly, cutting of the tape 4 can be made further smoothly. Although the rotation support portion 49 and the contact support portion 50 are shown disposed at both corners of a linear side in the tape dispenser shown in the drawing, their positions are appropriate and can be selected arbitrarily. Further, at least one of the rotation support portion 49 and the contact support portion 50 may be disposed on the lower cover body 13.

Though not shown in the drawings, various modifications can be further made without departing from the gist of the present invention. For example, a peripheral wall portion of a roller can be utilized as the tape press portion 6, the clamp plate reception portion 27 can also be constructed to be displaced, and a cap can be provided for covering the blade portion 3 when the tape dispenser is not in use.

We claim:

1. A tape dispenser comprising: a main body having a dispensing end for dispensing a tape upon application of a pull-out force at a leading end of the tape, the main body having a size capable of being gripped by a hand of a user; a holding member in the main body for pivotally supporting a roll of the tape for permitting the roll of tape to undergo angular displacement about a pivot axis; a pressing member having a pressing portion at the dispensing end of the main body for receiving the tape from the roll and for pressing the tape against a surface for adhering the tape to the surface; clamping means for applying a clamping force to the tape to releasably clamp the tape at the dispensing end of the main body; and a cutting unit pivotally connected to the holding member and having a blade portion for cutting the tape at the dispensing end of the main body, the blade portion being displaceable between a first position toward the dispensing end of the main body and a second position away from the dispensing end of the main body; whereby displacement of the blade portion of the cutting unit from the first position toward the second position displaces the roll of tape angularly about the pivot axis to slacken a portion of the tape between the roll of tape and the leading end of the tape even when a pull-out force is not applied to the leading end of the tape.

2. A tape dispenser as claimed in claim 1; wherein the pressing member has a clamp plate portion disposed rearwardly of the pressing portion; and the main body has a clamp plate reception portion opposite to and facing the clamp plate portion of the pressing member; the clamp plate portion of the pressing member and the clamp plate reception portion of the main body together comprising the clamping means.

3. A tape dispenser as claimed in claim 2; wherein the main body has a support portion at the dispensing end thereof for contacting the surface when the blade portion of the cutting unit is displaced toward the second position; and wherein the blade portion of the cutting unit is displaced from the second position toward the first position in response to angular displacement of the main body with respect to the surface while the support portion is maintained in contact with the surface to cut the tape at the dispensing end of the main body.

4. A tape dispenser as claimed in claim 1; further comprising blade urging means for urging the blade portion of the cutting unit toward the first position.

5. A tape dispenser as claimed in claim 1; wherein the cutting unit has a first arm portion connected to the holding member for angularly displacing the holding member about the pivot axis when the cutting unit is displaced toward the second position.

6. A tape dispenser as claimed in claim 1; wherein the cutting unit has a second arm portion connecting the first arm portion to the blade portion, the second arm portion being disposed substantially perpendicular to the roll of tape for guiding the tape out of the dispensing end of the main body at a substantially perpendicular direction with respect to the roll of tape.

7. A tape dispenser as claimed in claim 1; wherein the main body comprises a first cover portion having a wall, a second cover portion having a wall, and connecting means for removably connecting the first and second cover portions to define a housing enclosing at least the holding member and the roll of tape.

8. A tape dispenser as claimed in claim 7; wherein the connecting means comprises a through-hole in the wall of the first cover portion, and at least one flexible protuberance extending from the wall of the second cover portion into the through-hole of the first cover portion.

9. A tape dispenser as claimed in claim 8; wherein the holding member is pivotally supported by the second cover portion of the main body.

10. A tape dispenser as claimed in claim 8; wherein at least one of the first and second cover portions of the main body 1s comprised of a transparent material.

11. A tape dispenser comprising: a main body having a dispensing end for dispensing a tape and a size capable of being gripped by a hand of a user; a holding member in the main body for supporting a roll of the tape for permitting the roll of tape to undergo displacement in a first direction; a pressing member having a pressing portion at the dispensing end of the main body for receiving the tape from the roll and for pressing the tape against a surface for adhering the tape to the surface; clamping means for releasably clamping the tape at the dispensing end of the main body; and a cutting unit connected to the holding member and having a blade portion for cutting the tape at the dispensing end of the main body, the blade portion being displaceable between a first position toward the dispensing end of the main body and a second position away from the dispensing end of the main body; whereby displacement of the blade portion of the cutting unit from the first position toward the second position displaces the roll of tape in the first direction to slacken a portion of the tape in the main body.

12. A tape dispenser as claimed in claim 11; wherein the pressing member has a clamp plate portion disposed rearwardly of the pressing portion; and the main body has a clamp plate reception portion opposite to and facing the clamp plate portion of the pressing member; the clamp plate portion of the pressing member and the clamp plate reception portion of the main body together comprising the clamping means.

13. A tape dispenser as claimed in claim 12; wherein the main body has a support portion at the dispensing end thereof for contacting the surface when the blade portion of the cutting unit is displaced toward the second position; and wherein the blade portion of the cutting unit is displaced from the second position toward the first position in response to angular displacement of the main body with respect to the surface while the support portion is maintained in contact with the surface to cut the tape at the dispensing end of the main body.

14. A tape dispenser as claimed in claim 11; further comprising blade urging means for urging the blade portion of the cutting unit toward the first position.

15. A tape dispenser as claimed in claim 11; wherein the main body 1s comprised of a transparent material.

16. A tape dispenser comprising: a main body having a first end for dispensing a tape, and a second end; holding means supported at the second end of the main body for supporting a roll of the tape for permitting the roll of tape to undergo displacement in a first direction; pressing means supported at the first end of the main body for receiving the tape from the roll of tape and for pressing the tape against a surface for adhering the tape to the surface; clamping means for clamping the tape at the first end of the main body; and cutting means for cutting the tape at the first end of the main body, the cutting means being pivotally connected to the holding means for displacing the roll of tape in the first direction.

17. A tape dispenser as claimed in claim 16; wherein the cutting means comprises a blade portion for cutting the tape, the blade portion being displaceable between a first position toward the first end of the main body and a second position away from the first end of the main body; and wherein when the blade portion is displaced from the first position toward the second position, the roll of tape is displaced in the first direction to slacken a portion of the tape in the main body.

18. A tape dispenser as claimed in claim 17; further comprising blade urging means for urging the blade portion of the cutting means toward the first position.

19. A tape dispenser as claimed in claim 16; wherein the pressing means comprises a pressing portion and a clamp plate portion disposed rearwardly of the pressing portion; and the main body has a clamp plate reception portion opposite to and facing the clamp plate portion of the pressing means; the clamp plate portion of the pressing means and the clamp plate reception portion of the main body together comprising the clamping means.

20. A tape dispenser as claimed in claim 16; wherein the main body has a support portion at the first end thereof for contacting the surface when the blade portion of the cutting means is displaced toward the second position; and wherein the blade portion of the cutting means is displaced from the second position toward the first position upon angular displacement of the main body with respect to the surface while the support portion is maintained in contact with the surface.

21. A tape dispenser as claimed in claim 16; wherein the cutting means comprises a blade portion for cutting the tape at the first end of the main body, and a first arm portion disposed rearwardly of the blade portion and connected to the holding means for displacing the roll of tape in the first direction.

22. A tape dispenser as claimed in claim 21; wherein the cutting means further comprises a second arm portion connecting the first arm portion to the blade portion, the second arm portion being disposed substantially perpendicular to the roll of tape for guiding the tape out of the dispensing end of the main body 1n a substantially perpendicular direction with respect to the roll of tape.

23. A tape dispenser as claimed in claim 16; wherein the main body comprises a first cover portion having a wall, a second cover portion having a wall, and connecting means for removably connecting the first and second cover portions to define a housing enclosing at least the holding member and the roll of tape.

24. A tape dispenser as claimed in claim 23; wherein the connecting means comprises a through-hole in the wall of the first cover portion, and at least one flexible protuberance extending from the wall of the second cover portion into the through-hole of the first cover portion.

25. A tape dispenser as claimed in claim 24; wherein the holding means is pivotally supported by the second cover portion of the main body.

26. A tape dispenser as claimed in claim 25; wherein at least one of the first and second cover portions of the main body 1s comprised of a transparent material.

27. A tape dispenser as claimed in claim 16; wherein the main body 1s comprised of a transparent material.

28. A tape dispenser comprising: a housing having a wall and a dispensing end defined in the wall for dispensing a tape from inside the housing; a holding member movably disposed on the housing wall and spaced apart from the dispensing end for supporting the tape; a pressing member disposed on the housing wall near the dispensing end of the housing for receiving the tape and having a press portion for pressing the tape to be dispensed on a surface; and a floating cutting unit having first and second ends, the first end being connected to the holding member, and the second end supporting a cutting portion movable between a first position for moving the holding member in a direction towards the dispensing end of the housing and a second position for cutting the dispensed tape.

29. A tape dispenser as claimed in claim 28; further comprising a biasing member for biasing the cutting portion of the floating cutting unit to the second position.

30. A tape dispenser as claimed in claim 28; wherein the floating cutting unit has an actuating portion pivotally connecting the first end of the floating cutting unit to the holding member for moving the holding member in the direction toward the dispensing end of the housing to slacken a portion of the tape disposed inside of the housing between the holding member and the dispensing end of the housing when the cutting portion is in the first position.

31. A tape dispenser as claimed in claim 28; further comprising a clamping unit for clamping the tape at the dispensing end of the housing during movement of the cutting portion of the floating cutting unit between the first and second positions.

32. A tape dispenser as claimed in claim 31; wherein the clamping unit comprises a first clamp plate portion defined in the wall of the housing at the dispensing end thereof and a second clamp plate portion defined by the pressing member and disposed opposite to and facing the first clamp plate portion.

33. A tape dispenser as claimed in claim 32; further comprising a biasing member for biasing the cutting portion of the floating cutting unit to the second position.

34. A tape dispenser as claimed in claim 33; wherein the floating cutting unit has an actuating portion pivotally connecting the first end of the floating cutting unit to the holding member for moving the holding member in the direction toward the dispensing end of the housing to slacken a portion of the tape disposed inside of the housing between the holding member and the dispensing end of the housing when the cutting portion is in the first position.

35. A tape dispenser as claimed in claim 28; wherein the housing has a support portion at the dispensing end thereof for contacting the surface when the cutting portion of the floating cutting unit is in the first position; and wherein the cutting portion is moved from the first position to the second position upon angular displacement of the housing with respect to the surface while the support portion is maintained in contact with the surface.

36. A tape dispenser as claimed in claim 28; wherein the housing comprises first and second removably connected cover portions.

37. A tape dispenser as claimed in claim 36; wherein at least one of the first and second cover portions of the housing is comprised of a transparent material.

* * * * *